US005720587A

United States Patent [19]

Dietschi et al.

[11] Patent Number: 5,720,587

[45] Date of Patent: Feb. 24, 1998

[54] PROCESS AND ARRANGEMENT FOR FEEDING AN ARTICLE INTO A CONVEYING ARRANGEMENT

[76] Inventors: Roland Dietschi, Breitenäckerstrasse 33, 8918 Unterlunkhofen; Armin Ineichen, Rebbergstrasse 36, 5610 Wohlen, both of Switzerland

[21] Appl. No.: 554,191

[22] Filed: Nov. 6, 1995

[30] Foreign Application Priority Data

Nov. 28, 1994 [CH] Switzerland ..... 03 577/94

[51] Int. Cl.[6] ..... B23Q 5/22

[52] U.S. Cl. ..... 414/19; 271/270; 271/271; 198/479.1; 198/719; 198/722

[58] Field of Search ..... 198/479.1, 577, 198/719, 722; 414/18, 19; 271/270, 271

[56] References Cited

U.S. PATENT DOCUMENTS

| | | | |
|---|---|---|---|
| 1,886,378 | 11/1932 | Dearsley | 198/722 |
| 2,361,147 | 10/1944 | Nordstrom | 198/722 |
| 2,932,428 | 4/1960 | Mc Granahan . | |
| 3,834,691 | 9/1974 | Paulson . | |
| 3,994,389 | 11/1976 | Blair | 198/719 |
| 4,354,086 | 10/1982 | Opprecht | 198/577 |
| 5,395,103 | 3/1995 | Gysi et al. . | |

FOREIGN PATENT DOCUMENTS

| | | |
|---|---|---|
| A-0 575 707 | 12/1993 | European Pat. Off. . |
| B 52-30 700 | 7/1977 | Japan . |
| B 59-18 284 | 4/1984 | Japan . |

*Primary Examiner*—Joseph E. Valenza
*Attorney, Agent, or Firm*—McCormick, Paulding & Huber

[57] ABSTRACT

An article to be inserted in a conveying arrangement is picked up by the vane of a rotating element, and pushed into the conveying device. Because the motion of the element is rotational, a high feed rate can be achieved, and the article can be contacted without damage.

4 Claims, 1 Drawing Sheet

PROCESS AND ARRANGEMENT FOR FEEDING AN ARTICLE INTO A CONVEYING ARRANGEMENT

BACKGROUND OF THE INVENTION

The invention relates to a process for feeding an article which is resting on a supporting surface, in particular a sheet metal blank to form the body of a can, to a conveying arrangement. The invention also relates to an arrangement for carrying out the process.

It is a known process to remove sheet metal blanks from a stack by means of a suction element and to deposit them on a rest table. From this table, the sheet metal blank is propelled by an oscillating element to the delivery rollers of a conveying device. Such an arrangement is illustrated e.g. in FIG. 1 of EP-A 0575707. It is also known to provide a reciprocating slide for the sheet metal blank instead of the oscillating element illustrated there. The document EP-A 0575707 proposes the replacement of such arrangements by a direct feed of the sheet metal blank into the conveying device by the suction element. This, however, requires the suction elements to execute complex movements which, at high rates of delivery, can only be achieved at high equipment cost and/or with expensive lightweight materials.

One problem which arises in the destacking of sheet metal blanks which are used for the manufacture of cans is that ever-increasing welding speeds in the welding of the can seams mean that destacking at a rate of 1000 blanks per minute needs to be attained in order to make full use of the welding speeds available. However, care must also be taken to avoid damaging the edges of the blank, as this would impair the welding of the can body.

It is, of course, advantageous for other articles besides sheet metal blanks to be able to be fed rapidly and without damage from a support surface to a conveying device.

Accordingly, it is an object of the invention to provide a process and a device which allow individual articles to be fed to a conveying device without sustaining damage, and at very high rates.

SUMMARY OF THE INVENTION

The present invention resides in a method and apparatus for feeding an article such as a sheet metal blank onto a conveying arrangement. The apparatus which performs the method of the invention includes at least one element provided with a rotary drive and as the element rotates, it intersects the plane of a supporting surface to contact the article and accelerate the article toward the conveying device.

Making the element execute a rotational motion makes high handling rates much easier to manage than in the case of oscillating motions, and this allows the above-mentioned feed rate of 1000 blanks per minute to be attained. The rapid rotational motion also allows any idle travel to pickup of the next article to be absorbed quickly, thus, in principle, allowing sufficient time for gentle contact to be made with the article despite the high throughput.

Accordingly, the angular velocity of the element is preferably made non-uniform so that its velocity can be lower at the moment of contact than in the feed motion proper, or in the idle travel.

BRIEF DESCRIPTION OF THE DRAWINGS

Embodiments of the invention will now be described in detail by way of example, with reference to the drawings, in which.

Figure 3:
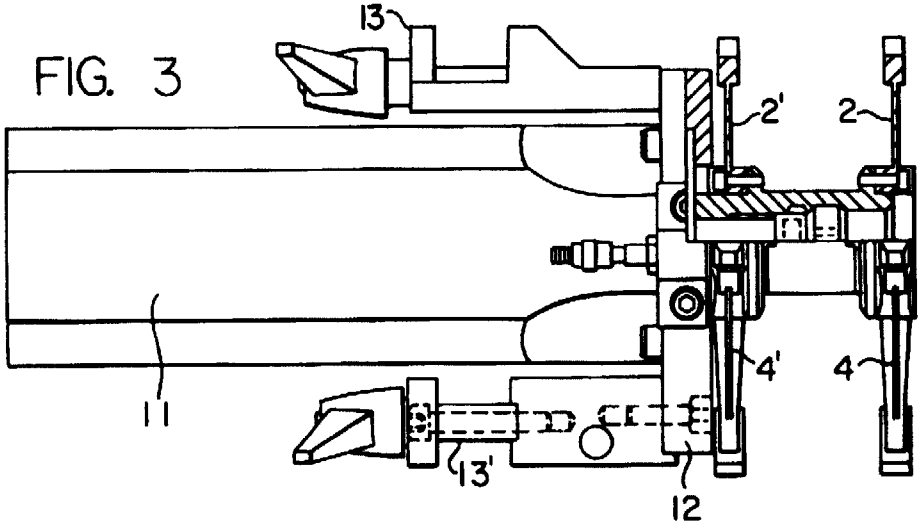
FIG. 3 is a side view, partly in section, of the arrangement shown in FIG. 1.
Figure 1:
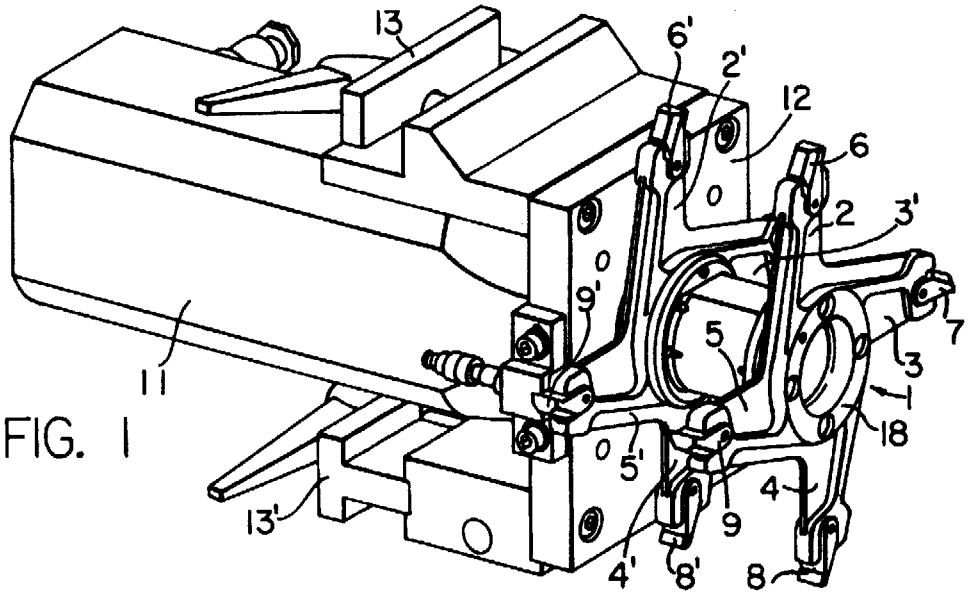
FIG. 1 is a perspective view of an arrangement according to the invention.
Figure 2:
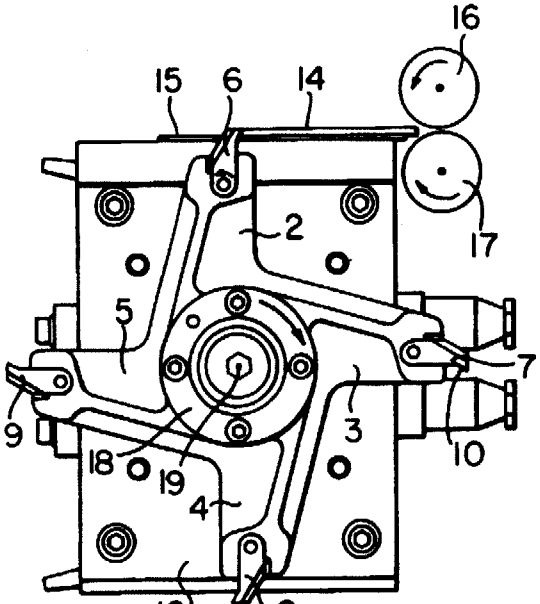
FIG. 2 is a front view of the arrangement shown in FIG. 1, with the conveying device indicated schematically.

The arrangement shown in perspective in FIG. 1 and in a front view in FIG. 2 is intended to feed a sheet metal blank 14 schematically illustrated in FIG. 2 from rest table 15 to conveying rollers 16 and 17 which constitute the first element of a conveying device for the sheet metal blank. For example, the sheet metal blank may be conveyed by the conveying device to a rounding unit in which it is rounded into a cylinder which is then welded to form a can body. This blank 14 is one of a whole series of blanks which are arranged in a stack above the support table 15, and which are individually removed from the stack, and placed on the support table 15, by a withdrawal device moving vertically in relation to the support table 15. As the withdrawal device is known, it is not described or illustrated here. Reference can be made e.g. to the description given in the above-mentioned, document EP-A-0575707. The function of the arrangement shown here is to convey the sheet metal blank 14 in a horizontal direction over the support table into the rollers 16 and 17, which grasp the blank and carry it on its way. For this purpose, in the example shown, the rotating element which impinges on the sheet metal blank 14 is in the form of a twin impeller wheel 1 provided with vanes 2, 3, 4 and 5 and 2', 3', 4' and 5', respectively. These vanes are arranged on a hub 18 with a central axis 19. The impeller wheel is rotated by an electrically controllable motor 11, this motor being arranged on a mounting flange 12 which carries fixing elements 13 and 13' which allow the motor and its accompanying impeller wheel or rotating element 1 to be fixed to a machine stand (not shown in detail) under the table 15.

The impeller wheel 1 is positioned under the table so that as it rotates, the outer ends of the vanes project through the support plane of the table 15. In other words, the vanes which are uppermost, i.e. vanes 2, 2' in the drawings, travel up through the table plane from below and then dips below the table plane again. As the rotation of the element 1 continues, the following vanes 5, 5' then execute the same movement, travelling through the table plane.

Before a given vane projects above the table plane, the synchronized withdrawal element (not shown) removes a blank from the stack arranged above the table, and places it on the table. When the vanes 2, 2' pass through the table plane, they impinge on the blank which has been placed in position and pushes it, in the plane of the table, towards the rollers 16 and 17. The rollers 16 and 17 remove the blank from the table at a higher velocity than that which has been imparted to it by the vanes 2, 2' and the vanes 2, 2' dip once more below the table plane. The next blank is then placed in position on the table 15 by the destacking device, and the pair of vanes 5, 5' of the element 1 push this blank to the delivery rollers. This process is then repeated by the next blank and the vanes 4, 4' and then by another blank and the vanes 3, 3' and so on.

The tips of the vanes are preferably provided with striking cams 6, 7, 8 and 9, and 6', 7', 8' and 9', respectively, which have a limited rocking action and are spring-mounted. The purpose of these spring-mounted striking cams is, firstly, to soften the impact of the individual vane on the sheet metal blank; the striking cam is able to pivot by a small amount and to be deflected against the action of the spring, thus protecting the edge of the blank from damage. Secondly, these spring-mounted striking cams, when mounted on a twin impeller wheel as illustrated in the drawings, have the function of compensating for slight positional deviations of the impeller wheel and/or of the deposited blank, ensuring that both striking cams, e.g. 6 and 6', take part in the feed of a given blank, which also serves to protect the edge of the blank from damage.

Preferably, the impeller wheel or rotatable element is driven at a non-uniform angular velocity. This is done by providing as the drive motor 11 an electrically controllable motor, e.g. a stepping motor or a controlled DC servo drive. Such motors or drives are known, and do not need to be described in detail here. The motor 11 may be controlled or governed by an internal control to adopt periodically changing angular velocities automatically as it rotates. Alternatively the angular velocity may be imparted to the motor by a centralized machine control system.

The angular velocity of the drive unit is preferably modified so that the velocity of the rotating element, or of the individual vane, is lowest when the element or vane makes contact with the edge of the blank. A rapid increase in angular velocity then occurs, accelerating the blank towards the rollers 16, 17. After the vane has dipped below the table plane, the velocity of rotation can be reduced again in order that the next vane makes contact with the blank at reduced speed.

The angular velocity of the drive may be varied e.g. so as to give an impact speed of the element on the blank of approximately 60 m/min. The angular velocity is then increased so that the speed of the blank upon reaching the end of the vane's stroke (which may be e.g. 35 mm) is approximately 350 m/min. The delivery rollers can then withdraw the blank from the table at a still higher velocity of approximately 450 m/min. After the element has dipped below the table plane, the speed of rotation is reduced again so that the next vane 5 strikes the edge of the next blank at a low impact speed. Contact with the blank is made e.g. some 15° before the vane reaches the vertical position. The leading edge of each striking cam which makes contact with the blank is provided with a forward slant 10 (FIG. 2) ensuring that when contacted by the cam 7 the blank, instead of rearing up, is conveyed in a straight path.

The arrangement illustrated as an example enables the blanks to be fed at a very high rate. Since there are no oscillating motions, no significant free inertia forces occur.

Although the present invention has been described in relation to the example of stacked sheet metal blanks, it is obvious that the advantages which have been portrayed also apply to other articles to be handled at high rates without sustaining any damage.

We claim:

1. Process for feeding a sheet metal blank which is resting on a support surface to a conveying arrangement for forming and welding a can body, comprising the steps of:

rotating at an angular velocity at least one element to engage an edge of a sheet metal blank, the element including at least two vanes having respective spring-loaded cam members at the vane tips which periodically project through a plane defined by the support surface as the element rotates;

reducing the angular velocity of the rotating element as each cam members approaches the plane and a blank resting on the support surface;

contacting the blank with one of the at least two spring-loaded cam members of the at least one element; and then increasing the angular velocity after the element contacts the blank to move the blank towards the conveying arrangement.

2. Process according to claim 1 wherein a series of sheet metal blanks are fed in succession and further comprising the step of:

withdrawing a blank engaged by the element using the conveying arrangement, wherein the step of reducing the angular velocity of the element is also performed after each blank is withdrawn into the conveying arrangement, and the step of increasing the angular velocity is performed to feed of the next blank.

3. Arrangement for feeding a sheet metal blank to form the body of a can which is resting on a supporting surface a conveying device, the supporting surface defining a planer comprising:

a rotatable element including at least two vanes having respective spring-loaded cam members located at the vane tips for engaging an edge of a sheet metal blank;

a rotary drive for rotating the element at a variable angular velocity so that each cam member rotates and intersects the plane of the supporting surface to contact a blank and accelerate it towards the conveying device, the angular velocity being slower as the element contacts a sheet metal blank and increased thereafter to feed the blank towards the conveying arrangement.

4. Arrangement according to claim 3, wherein the element is drivable by an electrically controllable motor.

* * * * *